US006454325B1

(12) United States Patent
Ramsey et al.

(10) Patent No.: US 6,454,325 B1
(45) Date of Patent: Sep. 24, 2002

(54) CLOSURE HAND LEVER THAT CAN BE USED IN CONFINED ENVIRONMENTS

(75) Inventors: Marc O Ramsey, West Bloomfield; Richard Cumming, Oakland Township, both of MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 09/467,807

(22) Filed: Dec. 20, 1999

(51) Int. Cl.[7] ..... A47B 95/02

(52) U.S. Cl. ..... 292/347; 292/336.3; 292/DIG. 31; 180/281; 70/278.7; 16/110.1; 16/111.1

(58) Field of Search ..... 292/347, 336.3, 292/DIG. 22, DIG. 23, DIG. 31; 180/281; 70/278.7; 16/110.1, 111.1

(56) References Cited

U.S. PATENT DOCUMENTS

| | | | | |
|---|---|---|---|---|
| 3,858,921 A | | 1/1975 | Kuki | |
| 4,038,718 A | | 8/1977 | Reilhac et al. | |
| 4,343,501 A | | 8/1982 | Meeks | |
| 4,412,696 A | | 11/1983 | Ishii et al. | |
| 4,475,754 A | | 10/1984 | Arlauskas et al. | |
| 4,482,179 A | | 11/1984 | Johnson | |
| 4,497,514 A | | 2/1985 | Moriya et al. | |
| 4,588,219 A | * | 5/1986 | Kobayashi et al. | 292/336.3 |
| 4,907,833 A | * | 3/1990 | Ogasawara et al. | 292/336.3 |
| 5,101,597 A | | 4/1992 | Pelachyk et al. | |
| 5,238,276 A | * | 8/1993 | Burns | 292/347 |
| 5,298,306 A | | 3/1994 | Miller | |
| 5,560,659 A | | 10/1996 | Dault | |
| 5,632,516 A | | 5/1997 | Schwab | |
| 5,706,554 A | | 1/1998 | Rüchert et al. | |
| D391,137 S | | 2/1998 | Moebius | |
| 5,758,454 A | | 6/1998 | Trap et al. | |
| 5,860,684 A | | 1/1999 | Mizuki | |
| 5,868,455 A | | 2/1999 | Springer et al. | |
| 5,884,434 A | | 3/1999 | Dedrich et al. | |
| 5,934,025 A | | 8/1999 | Trap et al. | |
| D441,270 S | * | 5/2001 | Ramsey et al. | D8/306 |
| 6,241,294 B1 | * | 6/2001 | Young et al. | 292/336.3 |

* cited by examiner

*Primary Examiner*—Anthony Knight
*Assistant Examiner*—Mark Williams
(74) *Attorney, Agent, or Firm*—Edwin W. Bacon, Jr.

(57) ABSTRACT

The present invention provides a closure handle lever comprising a gripping portion rotatably mounted along an axis and a catch lever rotatably mounted along this same axis. The catch lever is rotatable about the axis from a first position to a second position independent of the gripping portion. The first position provides a greater mechanical advantage for the gripping portion than the second position. The gripping portion is engaged to the catch lever such that rotation of the gripping portion about the axis causes rotation of the catch lever about this same axis.

8 Claims, 6 Drawing Sheets

CLOSURE HAND LEVER THAT CAN BE USED IN CONFINED ENVIRONMENTS

FIELD OF THE INVENTION

The present invention relates to a closure handle lever usable in confined environments, and more particularly to a closure handle lever used in confined environments which has a moveable portion to allow installation of the handle through confined spaces while maintaining a substantial mechanical advantage.

BACKGROUND OF THE INVENTION

Vehicle doors, such as lift gates on mini-vans, have handles which actuate a release mechanism and allow access to the rear compartment of the vehicle. Such handles typically comprise a gripping portion and a catch which are actually positioned on a shaft. Movement of the gripping portion results in movement of the catch. The catch, in turn, is connected by cable or other means to the latch mechanism. The torque required by a user pulling on the gripping portion is proportional to the length which the catch extends from the shaft. As such, it is desirable to extend the catch at least a minimum distance from the shaft to alleviate force required by the user.

While this type of device does provide an adequate opening mechanism, it has drawbacks in confined spaces. More specifically, the present design of mini-van doors incorporates various structural reinforcements on the interior of the door which inhibits installation of the mechanism. As a result, manufacturers have been forced to reduce the size of the catch in order to ease the installation process. The present invention was developed in light of this drawback.

SUMMARY OF THE INVENTION

It is therefore an object of the present invention to provide a closure handle lever which can be installed in confined areas while maintaining the desired mechanical advantage for a door user.

In accordance with the broad teachings of this invention, a closure handle lever is provided which has an advantageous construction. The closure handle lever comprises a gripping portion rotatably mounted along an axis and a catch lever rotatably mounted along this same axis. The catch lever is rotatable about the axis from a first position to a second position independent of the gripping portion. The first position provides a greater mechanical advantage for the gripping portion than the second position. The gripping portion is engaged to the catch lever such that rotation of the gripping portion about the axis causes rotation of the catch lever about this same axis.

Further areas of applicability of the present invention will become apparent from the detailed description provided hereinafter. It should be understood that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

Figure 1:
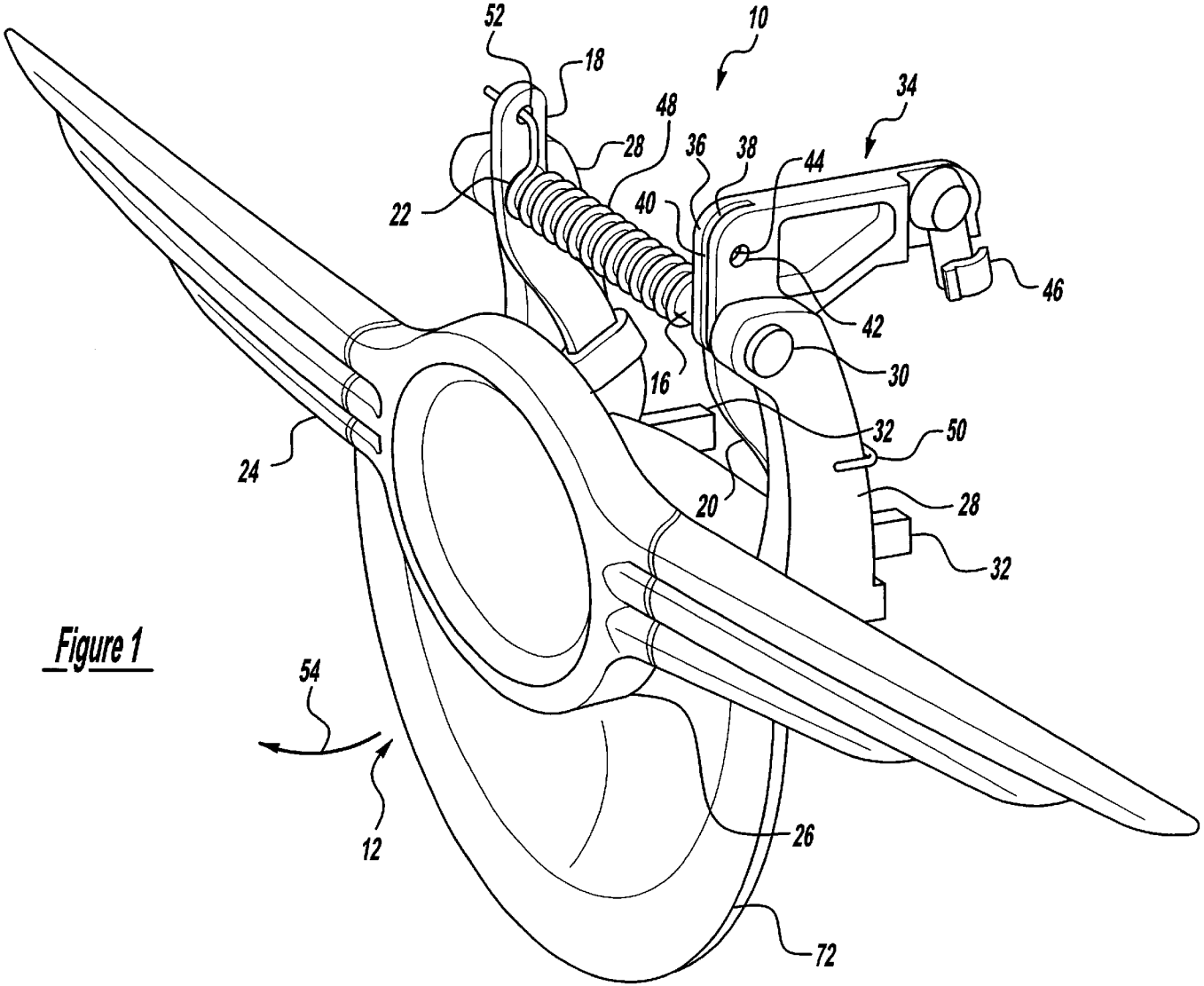
FIG. 1 is a perspective view of a closure handle according to the present invention.

Referring now to FIG. 1, a closure handle 10 is shown according to the present invention. Closure handle 10 includes a gripping portion 12 mounted on shaft 16 by first bracket 18 and second bracket 20. First bracket 18 and second bracket 20 each have apertures such as aperture 22 to allow shaft 16 to pass therethrough. Emblem 24 has a back side 26 to allow a user to place their fingers under to actuate the closure handle 10 (as will be discussed). Closure handle 10 also utilizes a pair of mounts 28 which contain apertures 30 to receive shaft 16. Mounts 28 also include extensions 32.

Catch lever 34, like gripping portion 12, is supported on shaft 16. As such, shaft 16 defines an axis about which both catch lever 34 and gripping portion 12 rotate. Catch lever 34 has a first support arm 36 and a second support arm 38. First support arm 36 and second support arm 38 surround and are adjacent to an upper portion 40 of second bracket 20. Detent 42 lockingly engages against a nub 44 which projects from the surface of upper portion 40. A latch attachment 46 is pivotally mounted to catch lever 34 at a position distally located from shaft 16.

Spring 48 encircles shaft 16 while engaging one of mounts 28 at area 50 and engages first bracket 18 at area 52.

In operation, gripping portion 12 is pulled by back side 26 in direction 54. This causes the rotation of first bracket 18 and second bracket 20 about shaft 16. In turn, upper portion 40 is levered against catch lever 34, thereby causing it to rotate about shaft 16 in the same direction as direction 54.

Figure 2:
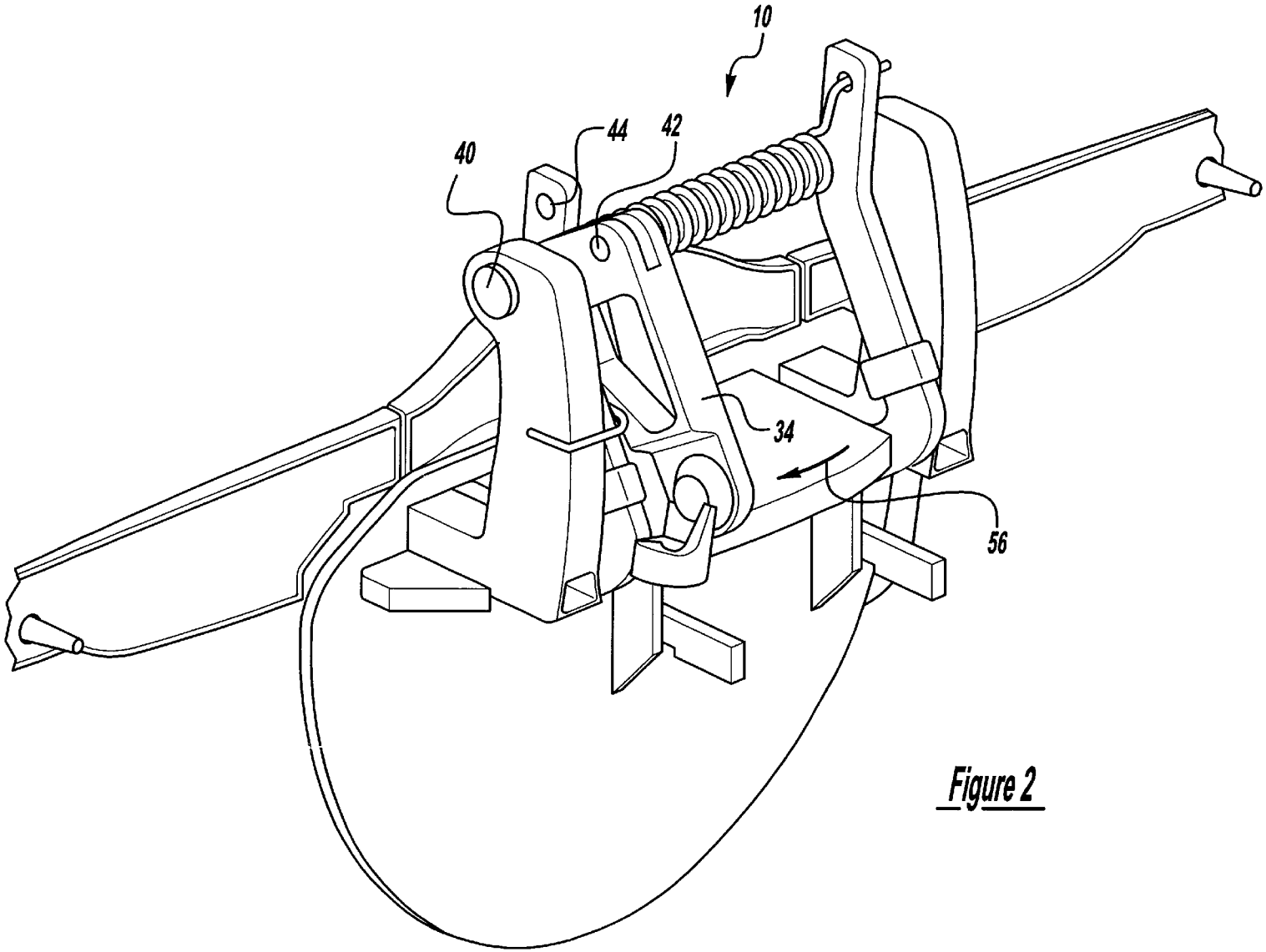
FIG. 2 is a perspective view of a closure handle according to the present invention.

Referring now to FIG. 2, when closure handle 10 is to be installed in the vehicle (as will be discussed in greater detail), catch lever 34 is rotated in direction 56 independently from gripping portion 12 and upper portion 40. As a result, nub 44 is disengaged from detent 42.

Figure 3:
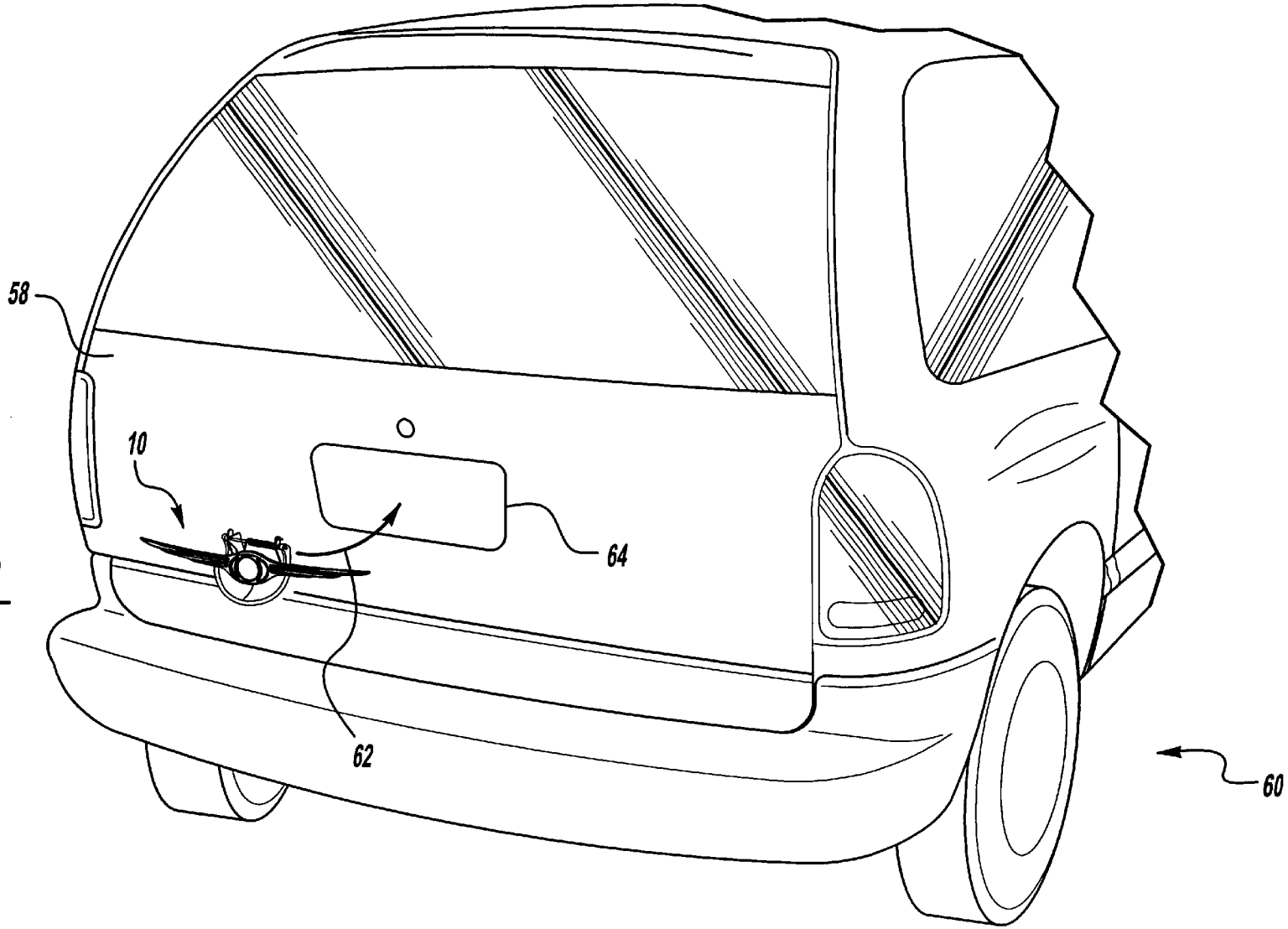
FIG. 3 is an environmental view of a closure handle used in conjunction with a vehicle according to the present invention.
Figure 4:
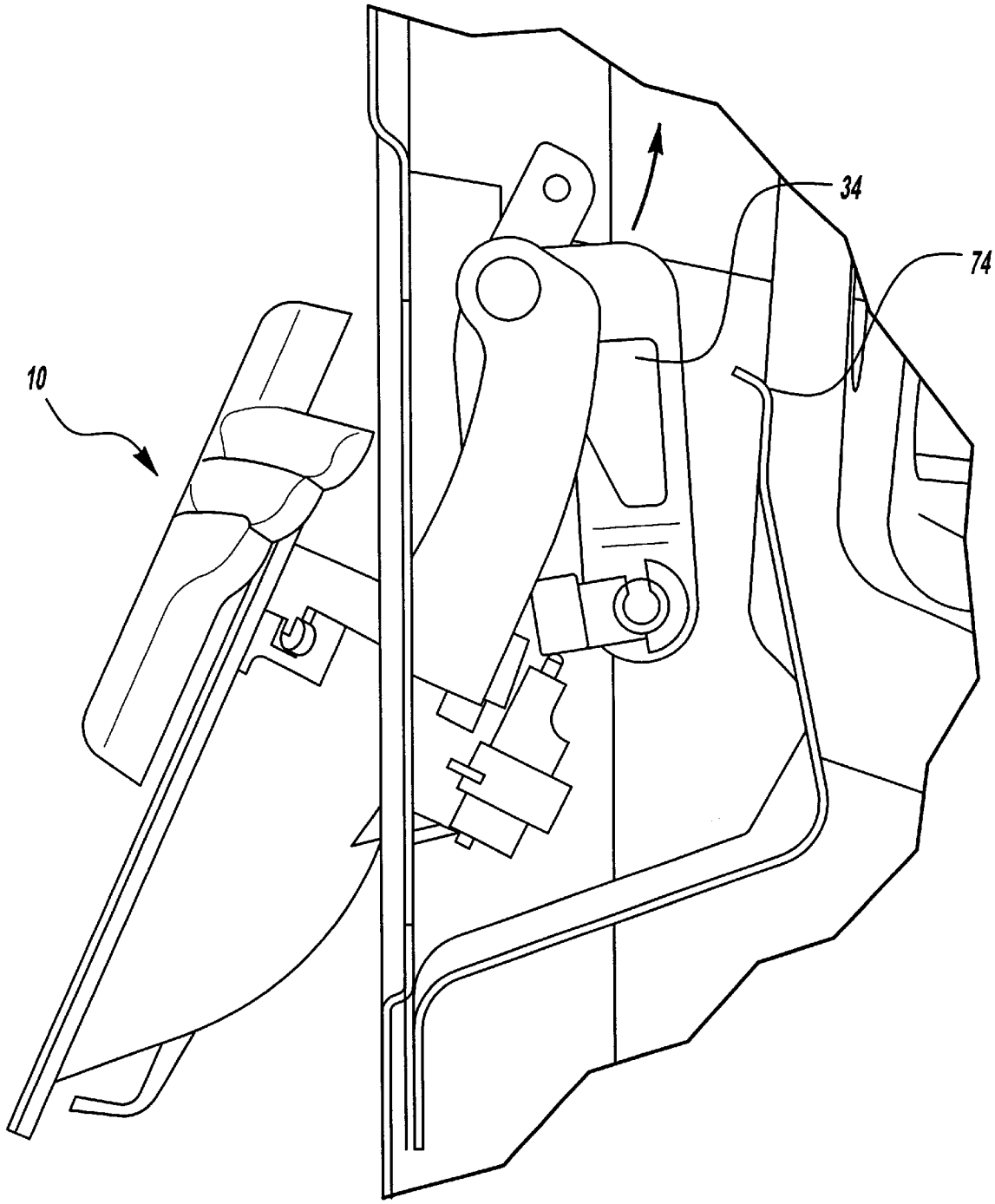
FIG. 4 is a cross-sectional view of a closure handle according to the present invention.
Figure 5:
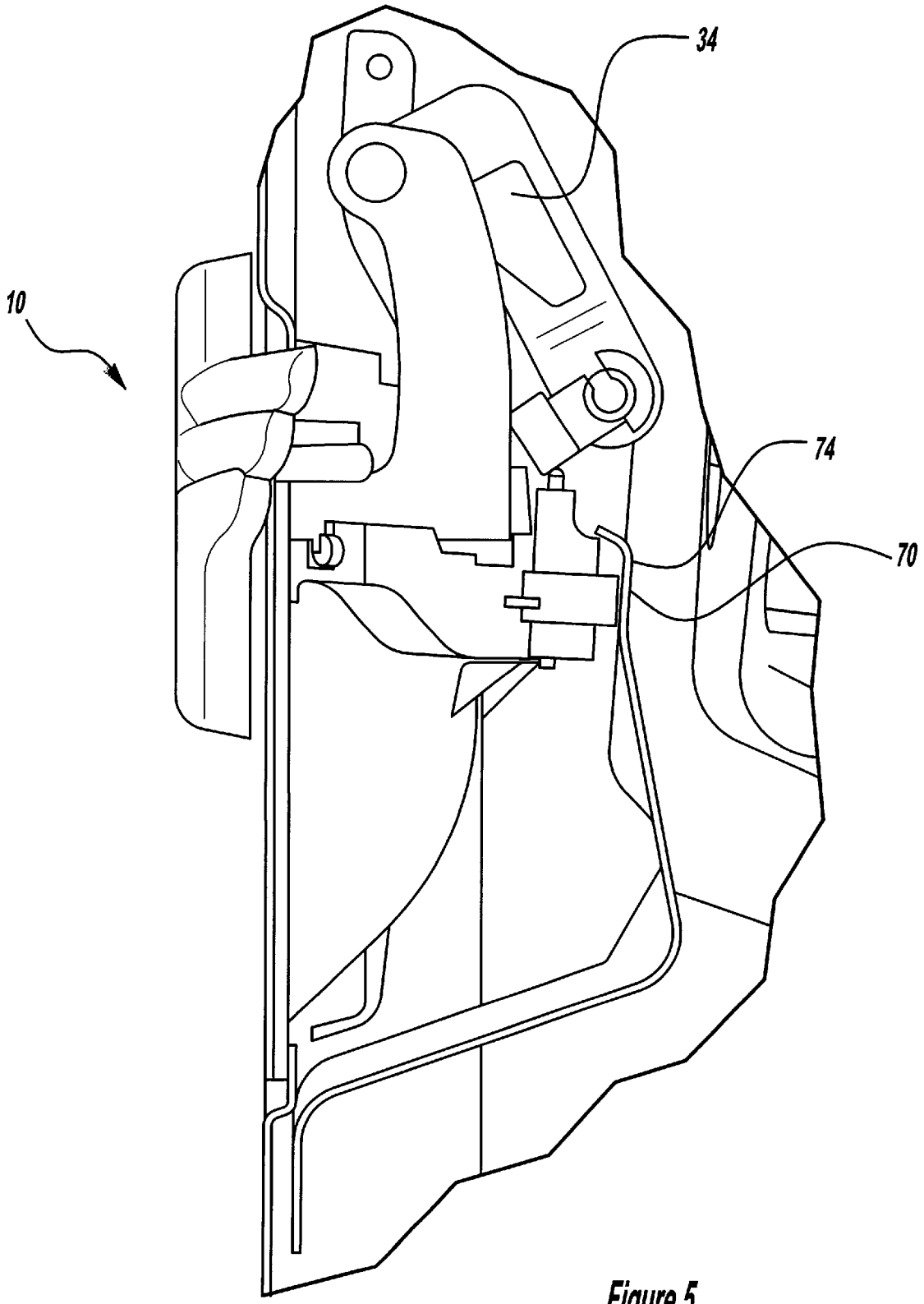
FIG. 5 is a cross-sectional view of a closure handle according to the present invention.
Figure 6:
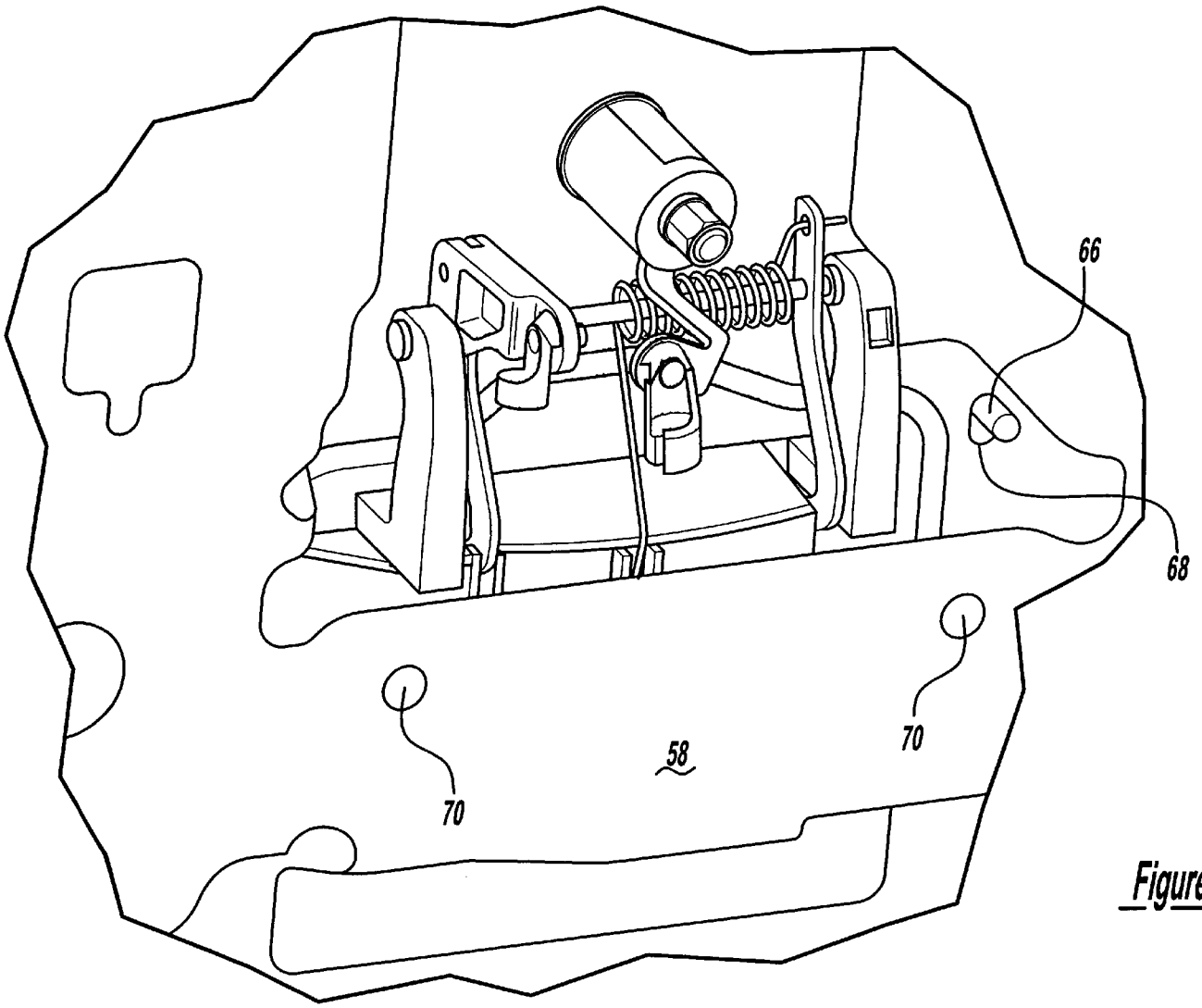
FIG. 6 is a perspective view of a closure handle according to the present invention.

Referring now to FIGS. 3, 4, and 5, installation of the present invention will now be described. In FIG. 3, closure handle 10 is shown positioned outside lift gate 58 of vehicle 60. When assembled, closure handle 10 is moved along arrow 62 and into aperture 64. In FIG. 4, closure handle 10 is shown being inserted into aperture 64 of lift gate 58. In this instance, closure handle 10 is inserted at an angle into aperture 64 and then is rotated counterclockwise to the position as shown in FIG. 5. As can be seen in FIG. 6, stud 66 engages aperture 68 and bolt attachments 70 affix to mount 72 to affix closure handle 10 to lift gate 58.

Next, as shown in FIG. 6, catch lever 34 is rotated opposite direction 56 (see FIG. 2) until detent 42 locks with nub 44. As can be seen in FIG. 4, catch lever 34 being in the second position allows closure handle 10 to be installed without interfering with support bracket 74.

The invention being thus described, it will be obvious that the same may be varied in many ways. Such variations are not to be regarded as a departure from the spirit and scope of the invention. Such variations or modifications, as would be obvious to one skilled in the art, are intended to be included within the scope of the following claims.

What is claimed is:

1. A door handle for an automobile, said door handle moveable between a closed position and an open position, said door handle comprising:

a gripping portion rotably mounted along an axis;

a catch lever rotatably mounted along said axis, said catch lever being adapted to engage and disengage said gripping portion;

said catch lever, when disengaged from said gripping portion, being rotatable about said axis between a first position and a second position independent of said gripping portion;

said gripping portion being initially disengaged from said catch lever and becoming engaged to said catch lever upon being rotated while said catch lever is in said fist position; and when engaged to said catch lever, rotation of said gripping portion about said axis causes rotation of said catch lever about said axis.

2. A door handle as claimed in claim 1, wherein said gripping portion and said catch lever are rotatably mounted on a shaft, said shaft defining said axis, said shaft being rotatably supported by two supports.

3. A door handle as claimed in claim 2, further comprising a spring element positioned around said shaft, said spring element engaging said gripping portion and said catch lever to bias said door handle in said closed position.

4. A door handle as claimed in claim 2, wherein said gripping portion is rotatably mounted on said shaft by a first bracket and a second bracket, said first bracket positioned on an opposite end of said shaft from said second bracket.

5. A door handle as claimed in claim 4, wherein said catch lever has a first support arm and a second support arm, said first support arm and said second support arm positioned on opposite sides of and adjacent to said second bracket.

6. A door handle as claimed in claim 5, wherein said second bracket has a detent lockingly engageable to said second support arm, whereby said detent locks said second support arm and said catch lever in said first position.

7. A door handle as claimed in claim 5, further comprising a latch attachment rotatably mounted in an end of said catch lever distal from said shaft.

8. A door handle as claimed in claim 5, wherein said catch lever extends perpendicular from a plane defined by said gripping portion when said catch lever is in said first position, said catch lever extends parallel to said plane when in said second position.

* * * * *